US008555976B2

(12) United States Patent
Ebenezer

(10) Patent No.: US 8,555,976 B2
(45) Date of Patent: Oct. 15, 2013

(54) EMERGENCY DISCONNECT SEQUENCE TIMER DISPLAY AND METHOD

(75) Inventor: Joseph Prem Ebenezer, Houston, TX (US)

(73) Assignee: Hydrill USA Manufacturing LLC, Houston, TX (US)

( * ) Notice: Subject to any disclaimer, the term of this patent is extended or adjusted under 35 U.S.C. 154(b) by 415 days.

(21) Appl. No.: 12/957,020

(22) Filed: Nov. 30, 2010

(65) Prior Publication Data

US 2012/0132430 A1 May 31, 2012

(51) Int. Cl.
*E21B 23/00* (2006.01)
*E21B 47/00* (2012.01)

(52) U.S. Cl.
USPC ..... 166/340; 166/352; 166/359; 166/363; 166/250.01; 166/66; 340/853.1

(58) Field of Classification Search
USPC ..... 166/340, 336, 351, 352, 359, 363, 166/250.01, 377, 66; 340/853.1, 853.2, 340/853.3, 853.9; 702/6
See application file for complete search history.

(56) References Cited

U.S. PATENT DOCUMENTS 4,234,047 A * 11/1980 Mott ..... 175/5
4,624,318 A * 11/1986 Aagaard ..... 166/359
4,921,048 A * 5/1990 Crow et al. ..... 166/372
5,046,896 A * 9/1991 Cole ..... 405/195.1
5,332,035 A * 7/1994 Schultz et al. ..... 166/53
5,657,823 A * 8/1997 Kogure et al. ..... 166/340
5,967,231 A * 10/1999 Laurel et al. ..... 166/250.04
6,047,781 A * 4/2000 Scott et al. ..... 175/5
6,056,071 A * 5/2000 Scott et al. ..... 175/5
6,068,069 A * 5/2000 Scott et al. ..... 175/5
6,085,851 A * 7/2000 Scott et al. ..... 175/7
8,181,704 B2 * 5/2012 Fenton ..... 166/338
8,305,227 B2 * 11/2012 Jaffrey et al. ..... 340/852
8,360,172 B2 * 1/2013 Santelmann ..... 175/61
2004/0173356 A1 * 9/2004 Dore et al. ..... 166/345
2006/0157252 A1 * 7/2006 Dore et al. ..... 166/358

* cited by examiner

*Primary Examiner* — Matthew Buck
(74) *Attorney, Agent, or Firm* — Bracewell & Giuliani LLP

(57) ABSTRACT

A rig control interface, system, and method. The rig control interface includes an emergency disconnect sequence button configured to initiate an emergency disconnect sequence signal to be sent to multiplex pods resulting in an emergency disconnect sequence including a plurality of functions being performed by devices in one or both of a lower marine riser package and a blowout preventer stack; and an emergency disconnect sequence timer display triggered by initiation of the emergency disconnect sequence signal, the emergency disconnect sequence timer display configured to indicate one or both of time elapsed after initiation of the emergency disconnect sequence signal and a status of the plurality of functions being performed by the devices in the one or both of the lower marine riser package and the blowout preventer stack.

25 Claims, 15 Drawing Sheets

EMERGENCY DISCONNECT SEQUENCE TIMER DISPLAY AND METHOD

BACKGROUND

1. Technical Field

Embodiments of the subject matter disclosed herein generally relate to methods and systems and, more particularly, to mechanisms and techniques for indicating the time elapsed after initiation of an emergency disconnect sequence.

2. Discussion of the Background

During the past years, with the increase in price of fossil fuels, the interest in developing new production fields has increased dramatically. However, the availability of land-based production fields is limited. Thus, the industry has now extended drilling to offshore locations, which appear to hold a vast amount of fossil fuel.

The existing technologies for extracting the fossil fuel from offshore fields may use a system 10 as shown in FIG. 1. More specifically, a blowout preventer stack ("BOP stack") 11 may be rigidly attached to a wellhead 12 upon the sea floor 14, while a Lower Marine Riser Package ("LMRP") 16 may be retrievably disposed upon a distal end of a marine riser 18, extending from a drill ship 20 or any other type of surface drilling platform or vessel. As such, the LMRP 16 may include a stinger 22 at its distal end configured to engage a receptacle 24 located on a proximal end of the BOP stack 11.

In typical configurations, the BOP stack 11 may be rigidly affixed atop the subsea wellhead 12 and may include (among other devices) a plurality of ram-type blowout preventers 26 useful in controlling the well as it is drilled and completed. Similarly, the LMRP 16 may be disposed upon a distal end of a long flexible riser 18 that provides a conduit through which drilling tools and fluids may be deployed to and retrieved from the subsea wellbore. Ordinarily, the LMRP 16 may include (among other things) one or more ram-type blowout preventers 26 at its distal end, an annular blowout preventer 30 at its upper end, and multiplex (MUX) pods 32.

A MUX pod system 40 is shown in FIG. 2 and may provide between 50 and 100 different functions to the BOP stack and/or the LMRP and these functions may be initiated and/or controlled from or via the MUX BOP Control System.

The MUX pod 40 may be fixedly attached to a frame (not shown) of the LMRP and may include hydraulically activated valves 50 (called in the art sub plate mounted ("SPM") valves) and solenoid valves 52 that are fluidly connected to the hydraulically activated valves 50. The solenoid valves 52 are provided in an electronic section 54 and are designed to be actuated by sending an electrical signal from an electronic control board (not shown). Each solenoid valve 52 may be configured to activate a corresponding hydraulically activated valve 50. The MUX pod 40 may include pressure sensors 56 also mounted in the electronic section 54. The hydraulically activated valves 50 are provided in a hydraulic section 58 and may be fixedly attached to the MUX pod 40.

A bridge between the LMRP 16 and the BOP stack 11 is formed that matches the multiple functions from the LMRP 16 to the BOP stack 11, e.g., fluidly connects the SPM valves 50 from the MUX pod provided on the LMRP to dedicated components on the BOP stack or the LMRP. The MUX pod system is used in addition to choke and kill line connections (not shown) or lines that ensure pressure supply for the shearing function of the BOPs.

The bridge is shown in FIG. 3 and may include a pod wedge 42 configured to engage a receiver 44 on the BOP stack. The pod wedge 42 has plural holes (not shown), depending on the number of functions provided, that provides hydraulic fluids from the LMRP 16 to the BOP stack 11.

In typical subsea blowout preventer installations, multiplex ("MUX") cables (electrical) and/or lines (hydraulic) transport control signals (via the MUX pod and the pod wedge) to the LMRP 16 and BOP stack 11 devices so the specified tasks may be controlled from the surface. Once the control signals are received, subsea control valves are actuated and (in most cases) high-pressure hydraulic lines are directed to perform the specified tasks. Thus, a multiplexed electrical or hydraulic signal may operate a plurality of "low pressure" valves to actuate larger valves to indicate the high-pressure hydraulic lines with the various operating devices of the wellhead stack.

Examples of communication lines bridged between LMRPs and BOP stacks through feed-thru components include, but are not limited to, hydraulic choke lines, hydraulic kill lines, hydraulic multiplex control lines, electrical multiplex control lines, electrical power lines, hydraulic power lines, mechanical power lines, mechanical control lines, electrical control lines, and sensor lines. In certain embodiments, subsea wellhead stack feed-thru components include at least one MUX "pod" connection whereby a plurality of hydraulic control signals are grouped together and transmitted between the LMRP 16 and the BOP stack 11 in a single mono-block feed-thru component as shown, for example, in FIG. 3.

When desired, ram-type blowout preventers of the LMRP 16 and the BOP stack 11 may be closed and the LMRP 16 may be detached from the BOP stack 11 and retrieved to the surface, leaving the BOP stack 11 atop the wellhead. For example, it may be necessary to retrieve the LMRP 16 from the wellhead stack in times of inclement weather or when work on a particular wellhead is to be temporarily stopped.

To retrieve the LMRP 16 from the wellhead stack, an Emergency Disconnect Sequence ("EDS") may be initiated. An EDS may include a number of different functions that are to be performed by the LMRP 16 and the BOP stack. The functions of the EDS may be carried out by the LMRP 16 and/or the BOP stack as set forth above via the MUX pod 40 and/or the bridge. A particular EDS may include a predetermined number of functions. For example, one particular EDS may include eighteen (18) functions while another EDS may include twenty-five (25) functions. A particular EDS may take a predetermined period of time to complete. For example, one particular EDS may take 20 (twenty) seconds to complete while another EDS may take 25 (twenty-five) seconds to complete. An EDS may be initiated using an EDS system 60 as shown in FIG. 4. An EDS may be initiated or fired by pressing an EDS button 62 located on a stack controller 64 located on the drill ship 20. Once the EDS is fired, each of the functions included in that EDS may be performed until all of the functions are complete.

An operator may desire to track the progress of the different functions and verify that the EDS is complete. An operator may choose to track the progress of the number of different functions or to verify that the EDS is complete by referring to a document 66 that may constitute one or more EDS charts (called in the art a FAT document). The document 66 may list information about the EDS. For example, the document 66 may list the order, name, and timing of the different functions of each EDS. In the example shown in FIG. 4, the first function is named "A" and occurs during the first three (3) seconds of the EDS, the second function is named "B" and occurs during the 4th through 7th seconds, the third function is named "C" and occurs during the 8th through 10th seconds, and so on in like manner for the total number of functions in the EDS. To track the progress of the functions of the EDS and to verify that the EDS is complete, an operator may take note of the time at which the EDS button 62 is pushed and then refer to the document 66. If, for example, nine (9) seconds have elapsed after the EDS button 62 was pushed, the operator may refer to the document 66 and see that function "C" may be in progress. However, this conventional approach is problematic. For example, if the operator makes an error in noting the time at which the EDS button is pushed, forgets to note the time altogether, or refers to the wrong portion of the document, the operator may not have an accurate measure of the progress of the different functions and may not be able to accurately determine when the EDS completes. This may lead to additional problems such as long wait times to verify that the EDS has completed. Further, this conventional approach is burdensome for the operator in that noting the time at which the EDS button is pushed and referring to the document 66 requires the attention of the operator.

Therefore, it is desired to provide a novel approach for indicating the time elapsed after initiation of an EDS.

SUMMARY

According to an exemplary embodiment, there is a rig control interface. The rig control interface includes an emergency disconnect sequence button configured to initiate an emergency disconnect sequence signal to be sent to multiplex pods resulting in an emergency disconnect sequence including a plurality of functions being performed by devices in one or both of a lower marine riser package and a blowout preventer stack; and an emergency disconnect sequence timer display triggered by initiation of the emergency disconnect sequence signal, the emergency disconnect sequence timer display configured to indicate one or both of time elapsed after initiation of the emergency disconnect sequence signal and a status of the plurality of functions being performed by the devices in the one or both of the lower marine riser package and the blowout preventer stack.

According to another exemplary embodiment, there is a rig control system. The rig control system includes a processor, a first plurality of sensors connected to a blowout preventer stack; a second plurality of sensors connected to a lower marine riser package releasably connectable to the blowout preventer stack; a multiplex pod connected to the lower marine riser package, the multiplex pod configured to receive an emergency disconnect sequence signal from the processor and to transport electric and/or hydraulic control signals to devices in one or both of the lower marine riser package and the blowout preventer stack in response to the emergency disconnect sequence signal; and a stack screen connected to the processor, the stack screen including: an emergency disconnect sequence button configured to initiate the emergency disconnect sequence signal sent to the multiplex pods resulting in an emergency disconnect sequence including a plurality of functions being performed by the devices in the one or both of the lower marine riser package and the blowout preventer stack; and an emergency disconnect sequence timer display triggered by initiation of the emergency disconnect sequence signal, the emergency disconnect sequence display configured to indicate one or both of time elapsed after initiation of the emergency disconnect sequence signal and a status of the plurality of functions being performed by the devices in the one or both of the lower marine riser package and the blowout preventer stack.

According to another exemplary embodiment, there is a method for disconnecting a lower marine riser package from a blowout preventer stack. The method includes receiving an emergency disconnect sequence initiation input, the emergency disconnect sequence initiation input to initiate an emergency disconnect sequence signal sent to multiplex pods resulting in an emergency disconnect sequence including a plurality of functions being performed by devices in one or both of a lower marine riser package and a blowout preventer stack; identifying the emergency disconnect sequence being fired; setting an emergency disconnect sequence timer to indicate one or both of time elapsed after initiation of the emergency disconnect sequence signal and a status of the plurality of functions being performed by the devices in the one or both of the lower marine riser package and the blowout preventer stack; and outputting the one or both of the time elapsed after initiation of the emergency disconnect sequence signal and the status of the plurality of functions being performed by the devices in the one or both of the lower marine riser package and the blowout preventer stack.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of an emergency disconnect sequence ("EDS") system provided with a stack screen for initiating an EDS. However, the embodiments to be discussed next are not limited to these systems, but may be applied to other systems that may include other interfaces, such as interfaces for initiating other sequences.

Reference throughout the specification to "an exemplary embodiment" or "another exemplary embodiment" means that a particular feature, structure, or characteristic described in connection with an embodiment is included in at least one embodiment of the subject matter disclosed. Thus, the appearance of the phrases "in an exemplary embodiment" or "in another exemplary embodiment" in various places throughout the specification is not necessarily referring to the same embodiment. Further, the particular features, structures or characteristics may be combined in any suitable manner in one or more embodiments.

According to an exemplary embodiment, an EDS timer (or timer display) may be provided to indicate the time elapsed after initiation of an EDS. In this way, the progress of different functions of the EDS may be accurately tracked and that the EDS is complete may be accurately verified. This may eliminate long wait times to verify that the EDS is complete. Further, this automatic tracking of the time elapsed after the initiation of the EDS is operator-friendly in that it eliminates burden from an operator.

Figure 1:
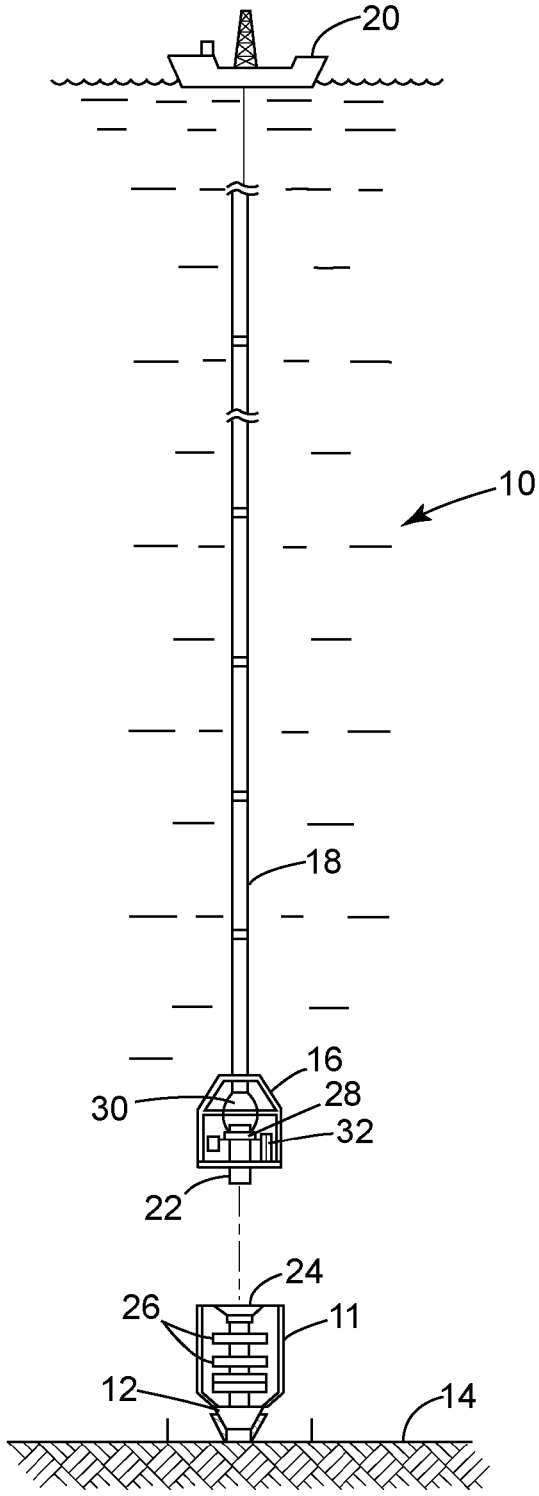
Figure 1 (Background Art)
FIG. 1 is a schematic diagram of a conventional offshore rig.
Figure 2:
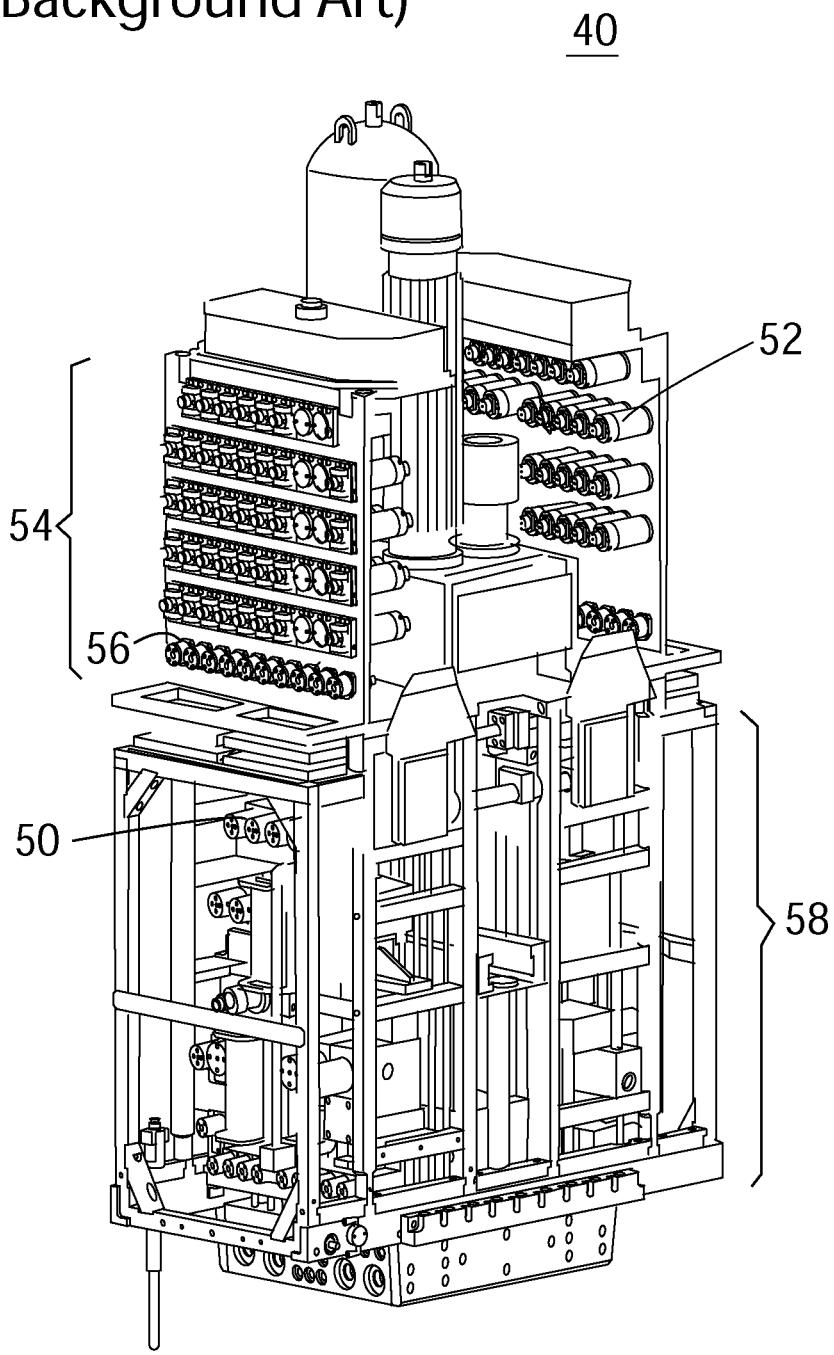
Figure 2 (Background Art)
FIG. 2 is a schematic diagram of a MUX pod.
Figure 3:
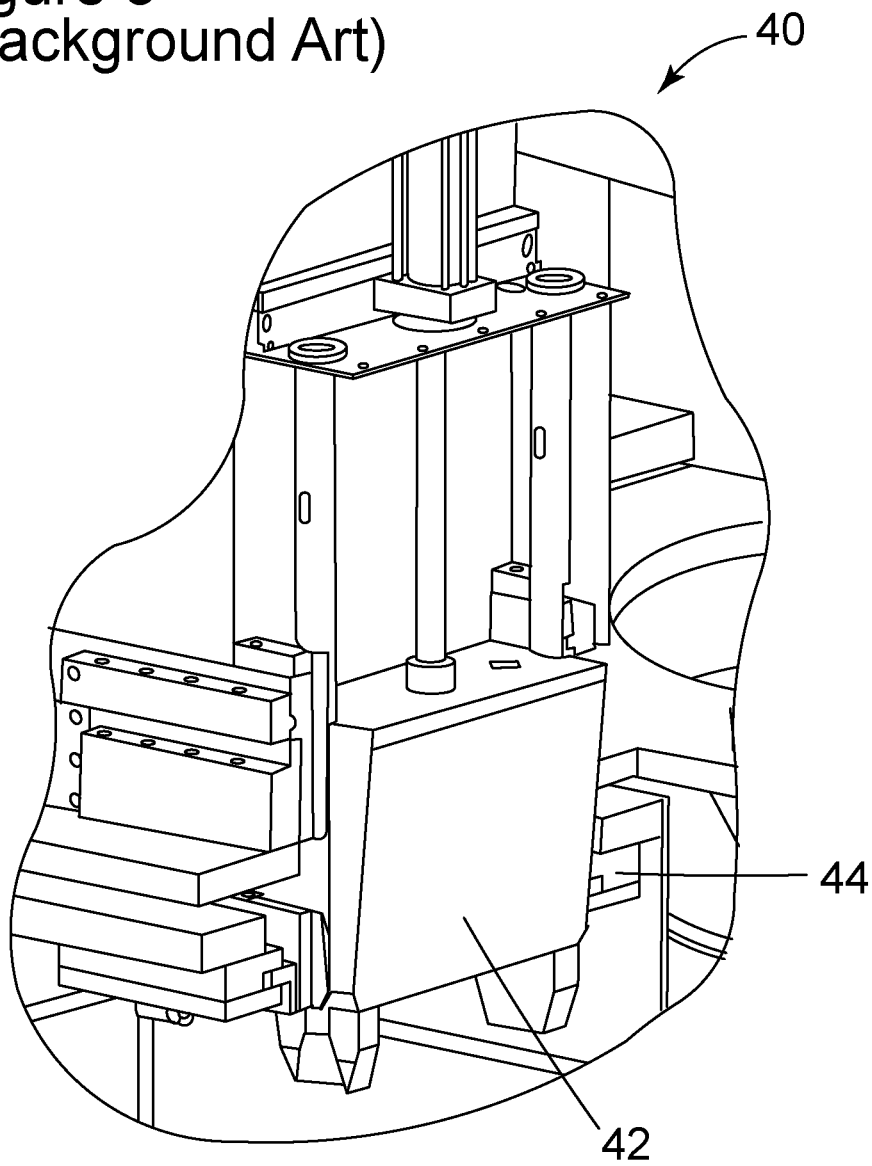
Figure 3 (Background Art)
FIG. 3 is a schematic diagram of a feed-thru connection of a MUX pod attached to a subsea structure.
Figure 4:
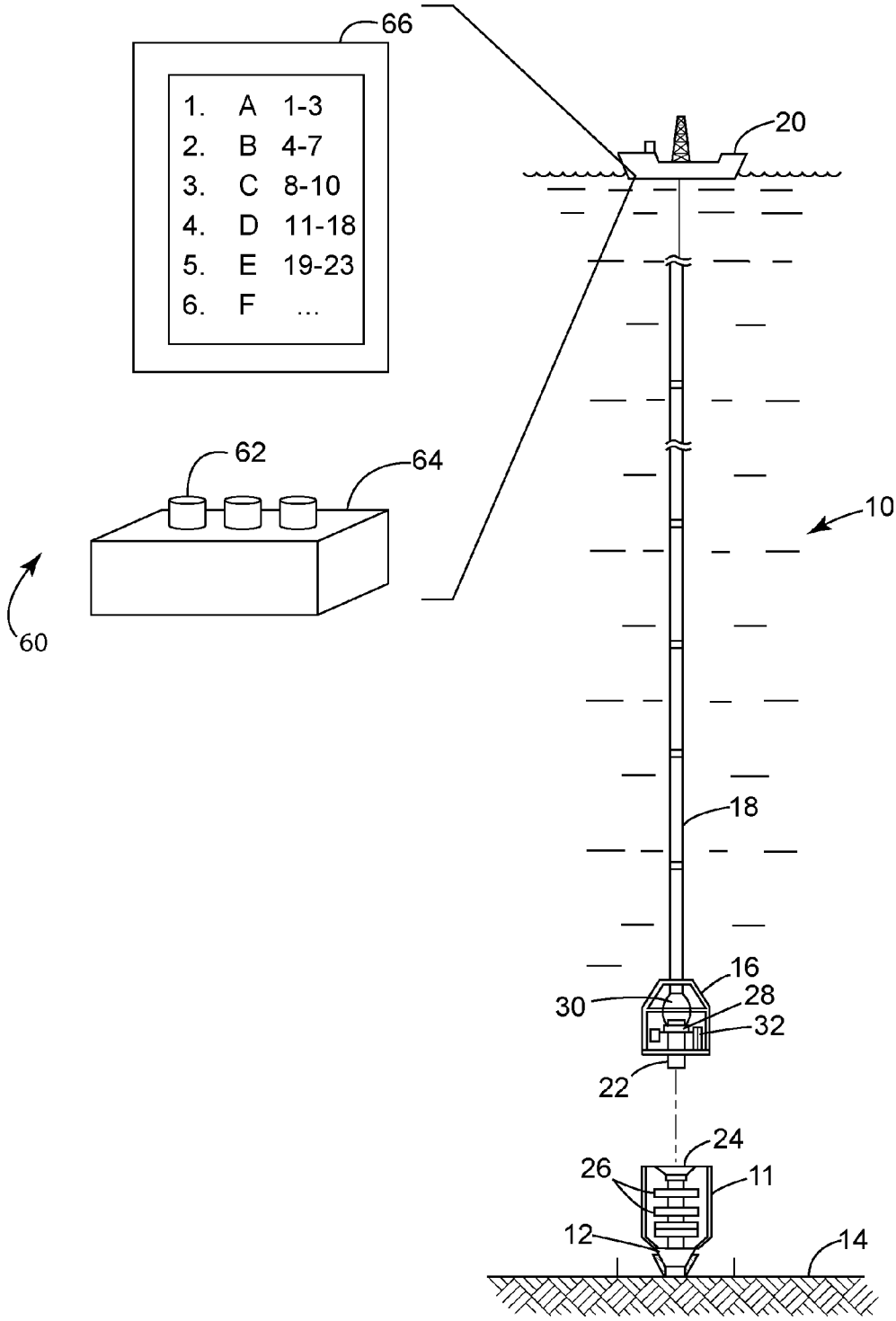
Figure 4 (Background Art)
FIG. 4 is a schematic diagram of a conventional EDS system.
Figure 5A:
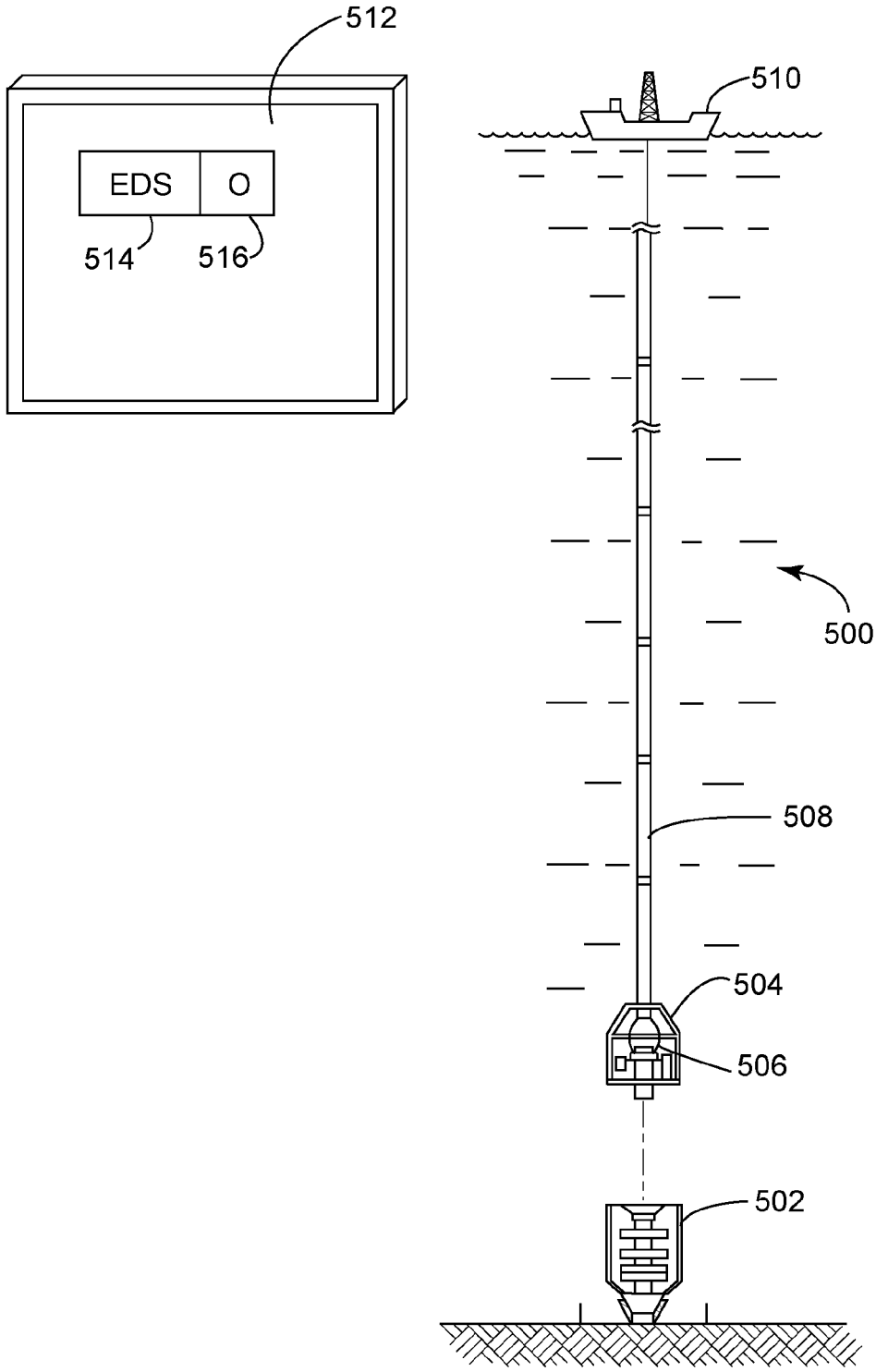
FIGS. 5A-7 are a schematic diagrams of an EDS system according to an exemplary embodiment.

According to an exemplary embodiment shown in FIG. 5A, an EDS system 500 may include a BOP stack 502, a LMRP 504, MUX pods 506, a marine riser 508, a drilling platform 510, and a stack screen 512. The LMRP 504 may be releasably connectable to the BOP stack 502. The MUX pods 506 may be connected to the LMRP 504. The marine riser 508 may be connected to the LMRP 504. The drilling platform 510 may be connected to the marine riser 508. The stack screen 512 may be located on the drilling platform 510.

Figure 5B:
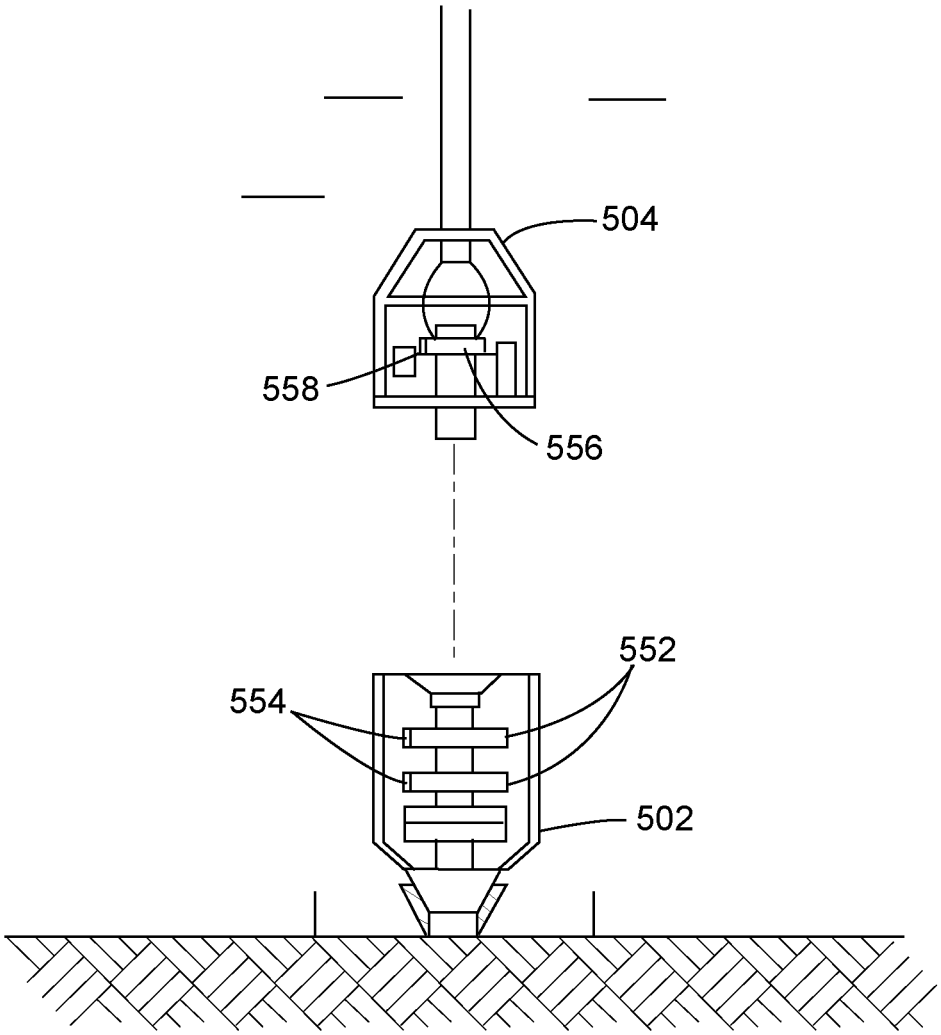

The MUX pods 506 may receive an EDS signal and may transport electric and/or hydraulic control signals to devices in the LMRP 504 and/or the BOP stack in response to the EDS signal. FIG. 5B is a schematic representation of exemplary devices in the LMRP 504 and the BOP stack 502. The exemplary devices may include a ram-type blowout preventers 552, 556. In addition, the exemplary devices in the LMRP 504 and the BOP stack 502 may include sensors. For example, the ram-type blowout preventers 552, 556 may include ram-type blowout preventer sensors 554, 558.

Returning to FIG. 5A, the stack screen 512 may include a number of different controls and displays including an EDS button 514 and an EDS timer 516. The EDS button 514 may initiate the EDS signal sent to the MUX pods and may result in an EDS including a plurality of functions being performed by the devices in the LMRP and/or the BOP stack. The EDS may include a predetermined number of functions as the plurality of functions and may last for a predetermined period of time. The EDS timer 516 may indicate the time elapsed after initiation of the EDS signal.

In an exemplary embodiment, the stack screen 512 may be a touch screen. In this exemplary embodiment, the stack screen 512 may include the EDS button 514 and the EDS timer as touch-screen displays. The EDS button touch-screen display may be located next to the EDS timer touch-screen display. The EDS timer touch-screen display may be a pop-up display that may be enlarged when in an active state. When the EDS timer touch-screen pop-up display is in an active state, visual access of the remaining remaining portion of the stack screen 512 may be inhibited.

In another exemplary embodiment, the stack screen may be a computer display. The stack screen may include the EDS button as a selectable control and the EDS timer as a display on the computer display. In another exemplary embodiment, the stack screen may be a physical control panel. The stack screen may include the EDS button as a physical button and the EDS timer as a display.

In the exemplary embodiment shown in FIG. 5A, the EDS timer 516 may include a numerical display of the time elapsed after the initiation of the EDS signal. In the exemplary embodiment, the numerical display includes whole seconds. However, the format of the display may be different. For example, in another exemplary embodiment, the numerical display may include seconds and fractions of a second. As discussed in the embodiments below, the display may include additional information such as progress bars.

Figure 6:
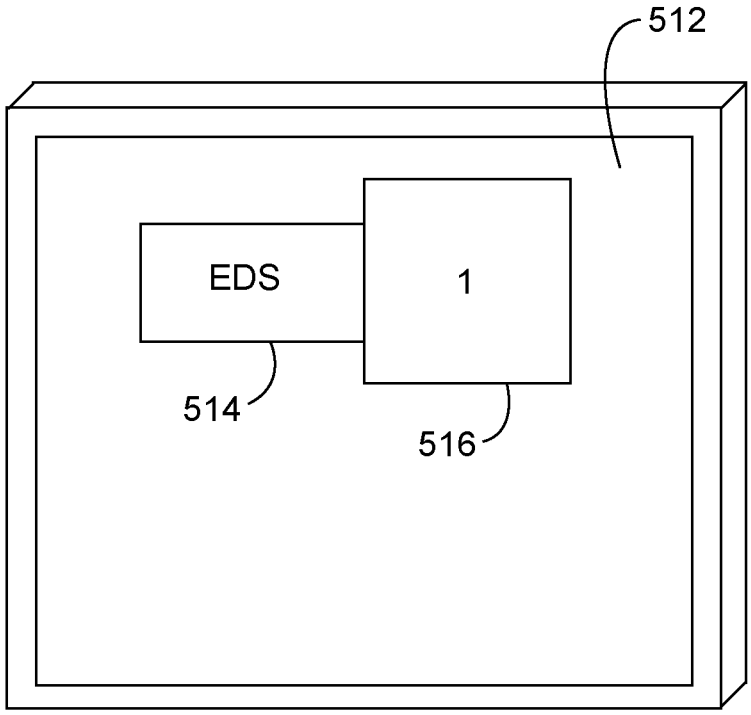
Figure 7:
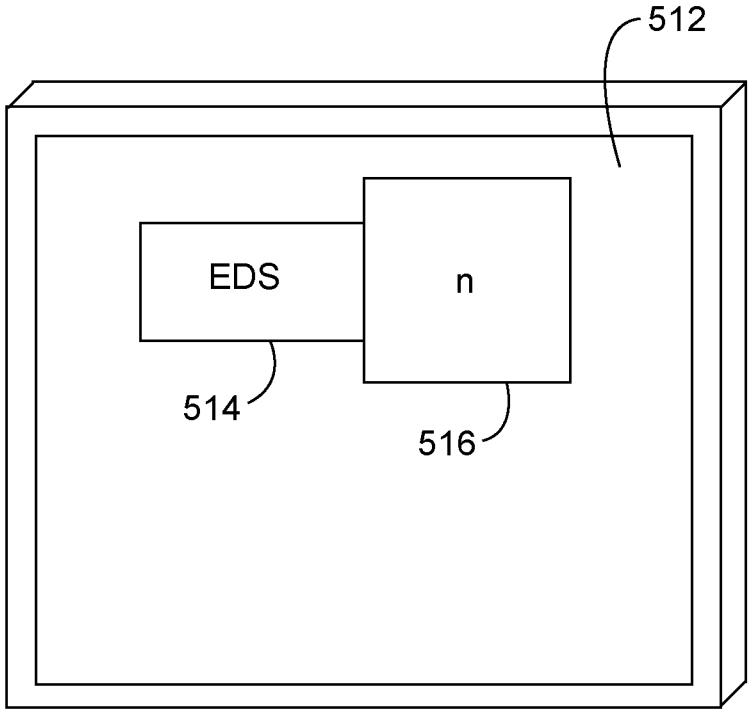

FIGS. 5A-7 show the EDS timer 516 at three different points in time relative to the initiation of the EDS signal. In FIG. 5A, the EDS timer 516 reads "0" indicating that no time has elapsed after the initiation of the EDS signal. In other words, the EDS signal has not yet been initiated as it is shown in FIG. 5A. Accordingly, the EDS timer touch-screen pop-up display may be in an inactive state and visual access of the remaining portion of the stack screen 512 may be restored. In FIG. 6, the EDS timer 516 reads "1" indicating that one (1) second has elapsed after the initiation of the EDS signal. During operation, the EDS timer touch-screen pop-up display may be in an active state and may be enlarged. It is noted that the stack screen 512 simultaneously displays other functions related to the operations of the rig, i.e., the stack screen 512 is very busy and the EDS button 514 occupies a small portion of the entire screen. Thus, having the EDS timer 516 provided adjacent to the EDS button 514 is very helpful for the operator. The visual access of the remaining portion of the stack screen 512 may be inhibited. As shown in FIG. 7, the EDS timer 516 may proceed to measure time "n" after initiation of the EDS signal in like manner for the predetermined period of time of the EDS and may indicate that time "n" has passed since the initiation of the EDS signal.

The stack screen 512 may include an EDS completion indicator. As noted above, in the exemplary embodiment shown in FIGS. 5A-7, when the EDS timer touch-screen pop-up display is in an active state, the EDS timer touch-screen pop-up display may be enlarged and visual access of the remaining portion of the stack screen 512 may be inhibited. The EDS completion indicator may be the resizing of the EDS timer touch-screen pop-up display and the restoring of visual access to the remaining portion of the stack screen 512. In other words, after the completion of the EDS, the EDS timer touch-screen pop-up display may be resized and visual access of the remaining portion of the stack screen (relative to the EDS timer) may be restored thereby indicating completion of the EDS. In another exemplary embodiment, the EDS timer may not be visible unless in an active state thereby indicating the start and completion of an EDS by appearing and then disappearing from the stack screen. In yet another exemplary embodiment, the EDS completion indicator may be a separate display on the stack screen.

Figure 8:
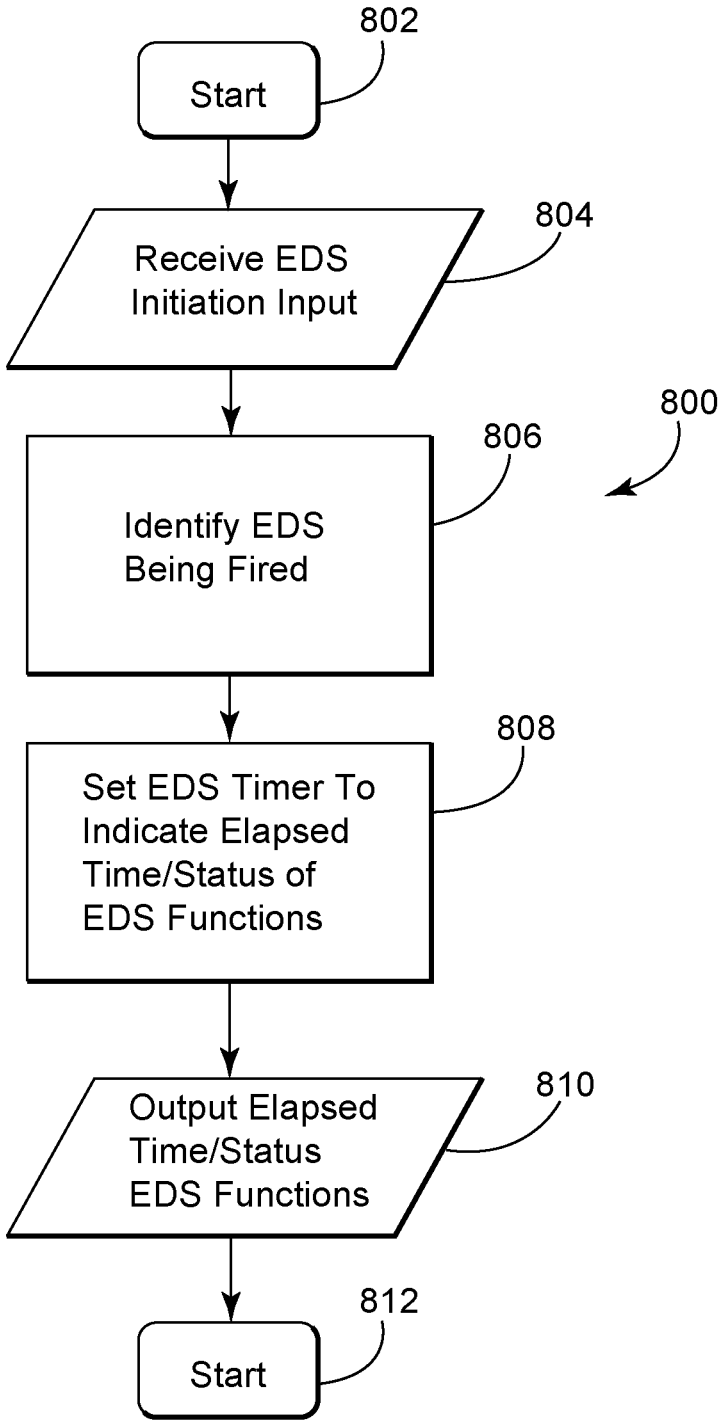
FIG. 8 is a flow chart of a method of an EDS system according to an exemplary embodiment.

The operation of the EDS system 500 of FIGS. 5A-7 is now described with reference to FIG. 8 which is a flow chart of a method 800 according to an exemplary embodiment.

In operation 802, the method may begin. Before initiation of an EDS, the EDS timer 516 may read "0" as shown in FIG. 5A. In operation 804, an initiation of the EDS may be received. For example, the EDS button 514 may be touched by an operator. In operation 806, an identification of the initiated EDS may be made. In operation 808, the EDS timer 516 may be set to indicate the time elapsed after the initiation of the identified EDS and/or the status of the plurality of functions performed by the devices in the LMRP 504 and/or the BOP stack 502. In an exemplary embodiment, the status of the plurality of functions performed by the devices (e.g., pressure, ram position, closed versus open) in the LMRP 504 and/or the BOP stack 502 may be determined by the sensors 554, 558 and communicated to the stack screen 512. In other words, the stack screen 512 may be in communication with the sensors 554, 558. In operation 810, the EDS timer may output the time elapsed after the initiation of the identified EDS and/or the status of the plurality of functions performed in the LMRP 504 and/or the BOP stack 502. During the EDS, the EDS timer 516 may read "1" or "n" as shown in FIGS. 6 and 7 indicating that one (1) second or "n" time has passed after initiation of the EDS signal. In operation 812, the method 800 may end. The method 800 may be repeated. That is, the EDS timer 516 may restart from "0" when the EDS button 514 is touched again.

Figure 10:
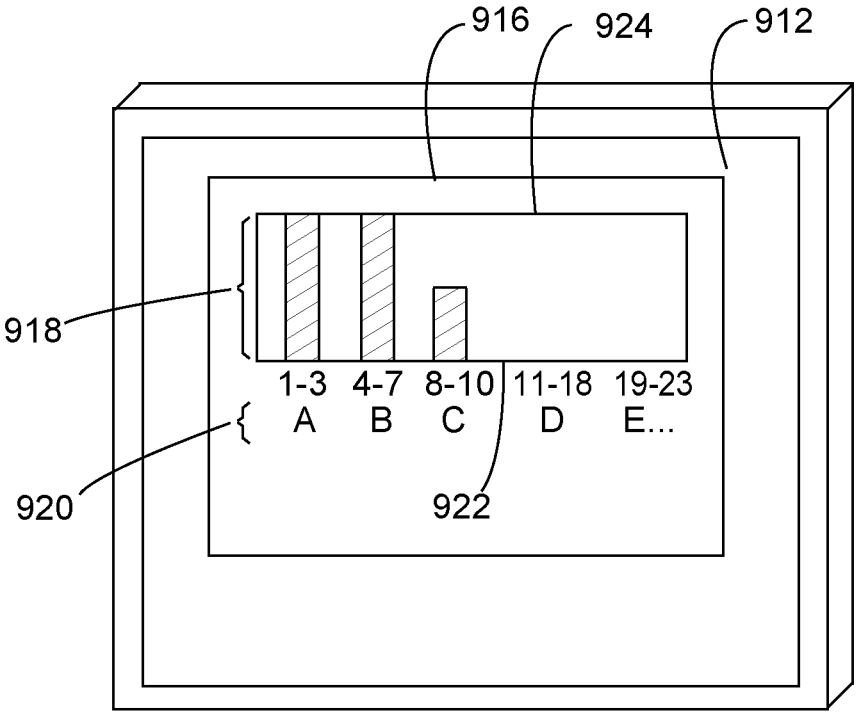
Figure 11:
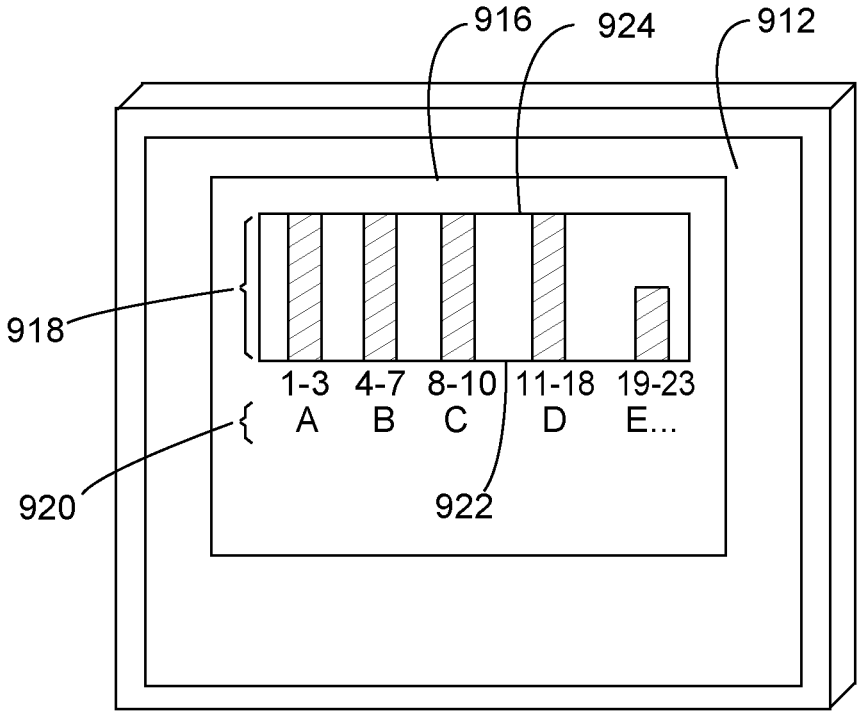

FIGS. 10-11 are schematic diagrams of a stack screen 912 according to another exemplary embodiment. FIGS. 10-11 show the EDS timer 916 at three different points in time relative to the initiation of the EDS signal. Various elements and operations of the stack screen 912 are similar to the elements and operations of the stack screen 512 of FIGS. 5A-7. Consequently, the description of these similar elements and operations will not be repeated in the interest of brevity.

Figure 9:
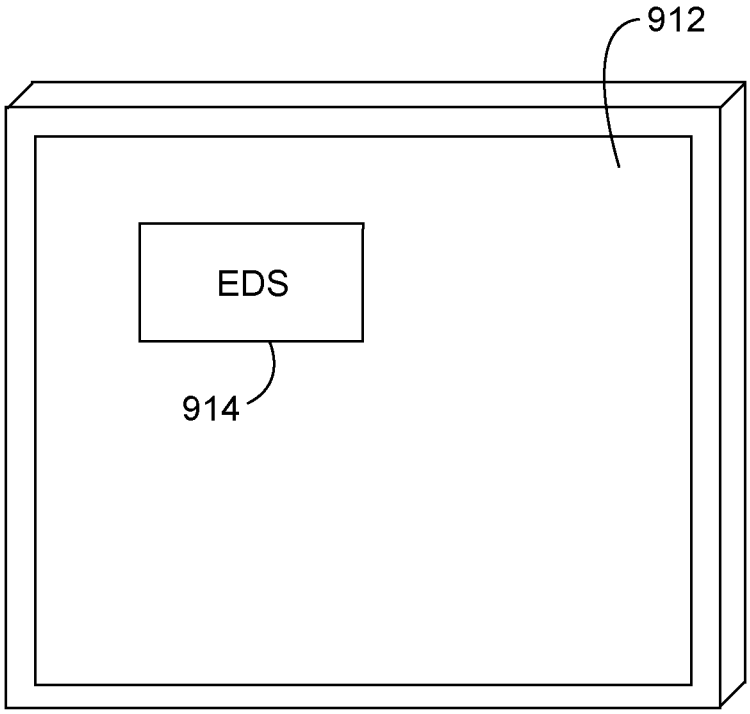
FIGS. 9-11 are schematic diagrams of an EDS system stack screen according to another exemplary embodiment.

Referring to FIG. 9, the stack screen 912 may include a number of different controls and displays including an EDS button 914. In FIG. 9, no EDS timer is displayed indicating that no time has elapsed after the initiation of the EDS signal. In other words, the EDS signal has not yet been initiated as it is shown in FIG. 9. Accordingly, the EDS timer display may be in an inactive state and visual access of the stack screen 912 may be restored. In FIG. 10, an EDS timer 916 may be displayed as a touch-screen pop-up display. The visual access of the remaining portion of the stack screen 912 may be inhibited. The EDS timer touch-screen pop-up display may include a graph area 918 and a name area 920. The graph area 918 may display a plurality of bar graphs. The name area may display a plurality of names of functions. Each bar graph may correspond to a particular function. For example, a first bar graph may correspond to a first function named "A" and may be displayed immediately above the name "A", a second bar graph may correspond to a second function named "B" and may be displayed immediately above the name "B", a third bar graph may correspond to a third function named "C" and may be displayed immediately above the name "C", and so on in like manner for the total number functions in the EDS. A time corresponding to each function may be presented for each bar graph. The time may be displayed between the graph area 918 and the name area 920.

In FIG. 10, a first bar graph corresponding to function "A" is shown extending from a bottom 922 of the graph area 918 to a top 924 of the graph area 918. Accordingly, the EDS timer 916 indicates that function "A" has completed. Time "1-3" is shown below the first bar graph. A second bar graph corresponding to function "B" is shown extending from the bottom 922 of the graph area 918 to the top 924 of the graph area 918. Accordingly, the EDS timer indicates that function "B" has completed. Time "4-7" is shown below the second bar graph. A third bar graph corresponding to function "C" is shown extending partway up from the bottom 922 of the graph area 918. However, the third bar graph does not extend all the way to the top 924 of the graph area 918. There are no bar graphs shown corresponding to functions "D" and "E". Accordingly, the EDS timer indicates that function "C" has started, but not yet completed, and that functions "D" and "E" have yet to execute. That is, the EDS timer indicates that the EDS is in progress and function "C" is presently being executed. Times "8-10", "11-18", and "19-23" are shown below the third bar graph and spaces for fourth and fifth bar graphs.

In FIG. 11, the bar graphs corresponding to functions "A", "B", "C", and "D" are shown extending from the bottom 922 of the graph area 918 to the top 924 of the graph area 918. Accordingly, the EDS timer 916 indicates that functions "A", "B", "C", and "D" have completed. Times "1-3", "4-7", "8-10", and "11-18" are shown below the first through fourth bar graphs. A fifth bar graph corresponding to function "E" is shown extending partway up from the bottom 922 of the graph area 918. However, the fifth bar graph does not extend all the way to the top 924 of the graph area 918. Accordingly, the EDS timer indicates that function "E" has started, but not yet completed. That is, the EDS timer indicates that the EDS is in progress and function "E" is presently being executed. Time "19-23" is shown below the fifth bar graph.

Figure 12:
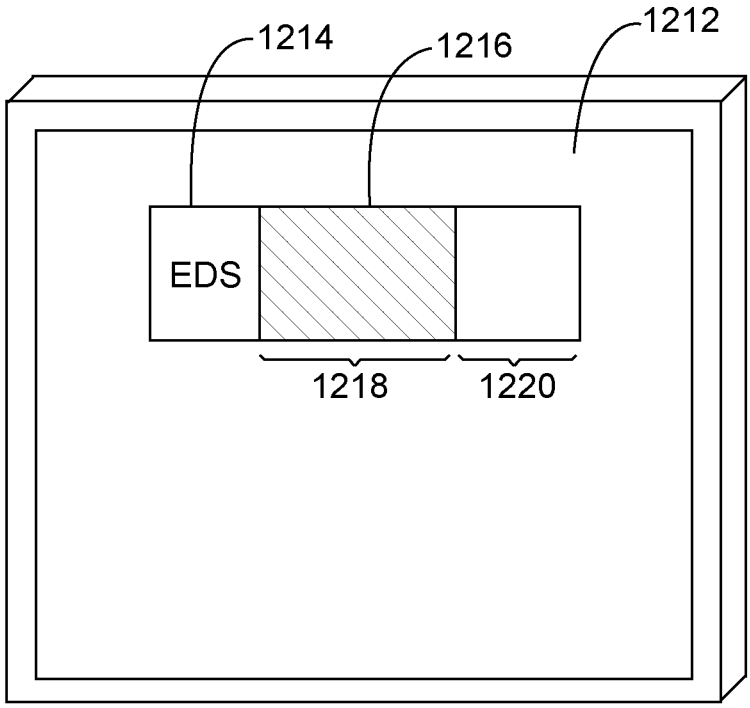
FIG. 12 is a schematic diagram of an EDS system stack screen according to another exemplary embodiment.

FIG. 12 is a schematic diagram of a stack screen 1212 according to another exemplary embodiment. Various elements and operations of the stack screen 1212 are similar to the elements and operations of the stack screen 512 of FIGS. 5A-7. Consequently, the description of these similar elements and operations will not be repeated in the interest of brevity.

The stack screen 1212 may include a number of different controls and displays including an EDS button 1214 and an EDS timer 1216. The EDS timer may be displayed as a touch-screen pop-up display. The EDS timer touch-screen display may be a pop-up display that may be enlarged when in an active state. When the EDS timer touch-screen pop-up display is in an active state, visual access of the remaining portion of the stack screen 1212 may be inhibited.

The EDS timer touch screen display may include a progress bar. The progress bar may include a completed portion 1218 and an uncompleted portion 1220. The completed portion 1218 and the uncompleted portion 1220 may be displayed in contrast with each other. For example, the completed portion 1218 may be displayed in green while the uncompleted portion 1220 may be displayed in red. The completed portion 1218 may extend while the uncompleted portion 1220 may shrink as the EDS progresses through a plurality of functions constituting the EDS.

In FIG. 12, the progress bar is shown having both a completed portion 1218 and an uncompleted portion 1220. Accordingly, the EDS timer 1216 indicates that the EDS is in progress but not yet complete.

Figure 13:
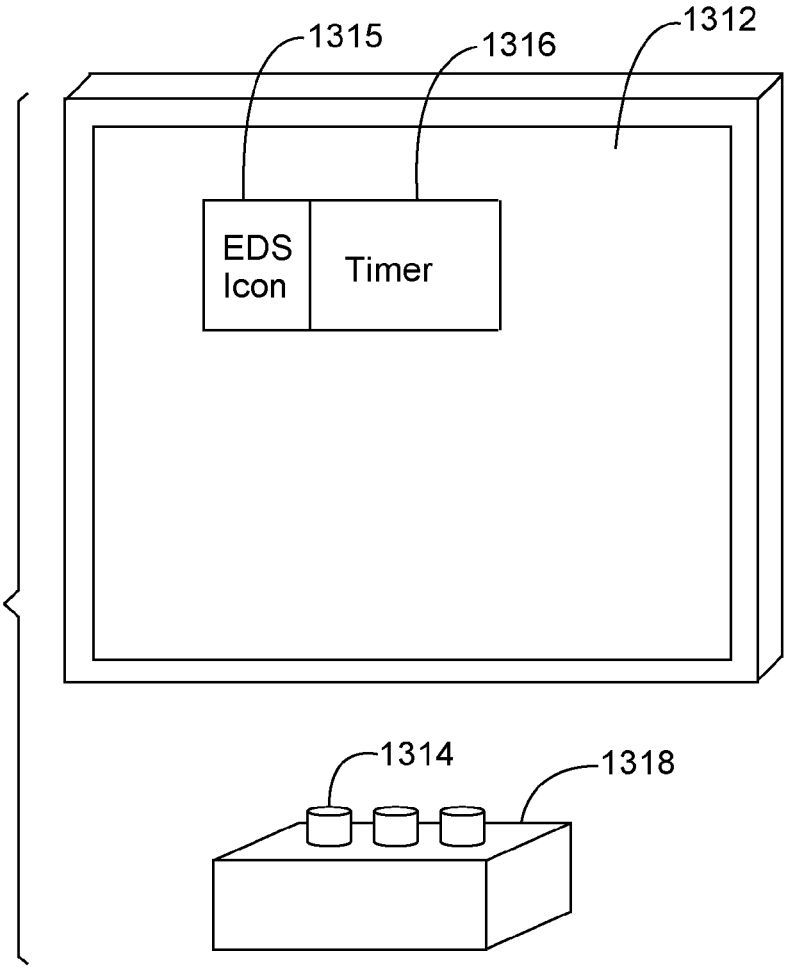
FIG. 13 is a schematic diagram of an EDS system stack screen and a control panel according to another exemplary embodiment

FIG. 13 is a schematic diagram of a stack screen 1312 and a control panel 1318 according to another exemplary embodiment. Various elements and operations of the stack screen 1312 and the control panel 1318 are similar to the elements and operations of the stack screen 512 of FIGS. 5A-7. Consequently, the description of these similar elements and operations will not be repeated in the interest of brevity.

The stack screen 1312 may include a number of different controls and displays including an EDS icon 1315 and an EDS timer 1316. The EDS icon and the EDS timer may be displayed as displays on a computer display. The control panel 1318 may include an EDS button 1314. The EDS icon 1315 on the stack screen may be activated when the EDS button 1314 is activated. The EDS timer 1316 may appear next to the EDS icon 1315 when the EDS button 1314 and the EDS icon 1315 are activated.

Figure 14:
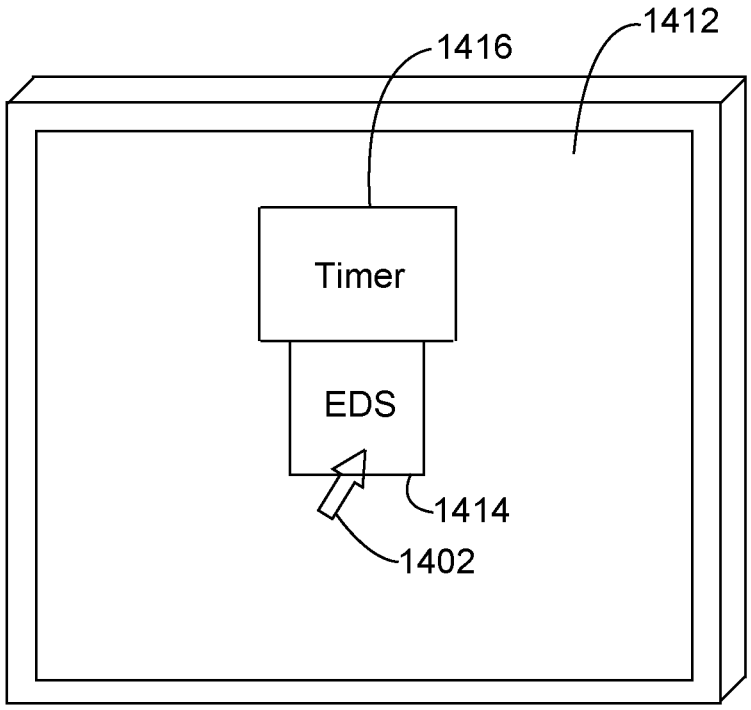
FIG. 14 is a schematic diagram of an EDS system stack screen according to another exemplary embodiment.

FIG. 14 is a schematic diagram of a stack screen 1412 according to another exemplary embodiment. Various elements and operations of the stack screen 1412 are similar to the elements and operations of the stack screen 512 of FIGS. 5A-7. Consequently, the description of these similar elements and operations will not be repeated in the interest of brevity. The stack screen 1412 may include a number of different controls and displays including an EDS button 1414 and an EDS timer 1416. The EDS timer 1416 may appear as a pop-up display when an operator places a cursor 1402 over the top of the EDS button 1414 when the EDS button is initiated. The timer pop-up display may disappear after completion of the EDS sequence. When the EDS button is not initiated, the timer pop-up display upon placing a cursor on the EDS button my display a message that the EDS sequence is not in progress.

The disclosed exemplary embodiments provide EDS systems and a method for indicating the time elapsed after initiation of an EDS. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A rig control interface comprising:

an emergency disconnect sequence button configured to initiate an emergency disconnect sequence signal to be sent to multiplex pods resulting in an emergency disconnect sequence including a plurality of functions being performed by devices in one or both of a lower marine riser package and a blowout preventer stack; and an emergency disconnect sequence timer display triggered by initiation of the emergency disconnect sequence signal, the emergency disconnect sequence timer display configured to indicate one or both of time elapsed after initiation of the emergency disconnect sequence signal and a status of the plurality of functions being performed by the devices in the one or both of the lower marine riser package and the blowout preventer stack.

2. The rig control interface of claim 1, wherein the interface is a touch screen including the emergency disconnect sequence button and the emergency disconnect sequence timer display as touch screen displays.

3. The rig control interface of claim 2, wherein the emergency disconnect sequence button touch-screen display is located adjacent to the emergency disconnect sequence timer touch-screen display.

4. The rig control interface of claim 2, wherein the emergency disconnect sequence timer touch-screen display is a pop-up display.

5. The rig control interface of claim 4, wherein when the emergency disconnect sequence timer touch-screen pop-up display is in an active state, visual access of the remaining portion of the touch screen is inhibited.

6. The rig control interface of claim 1 wherein the emergency disconnect sequence timer display includes a numerical display of the time elapsed after the initiation of the emergency disconnect sequence signal.

7. The rig control interface of claim 1, wherein the emergency disconnect sequence timer display includes a numerical display of time remaining for a specific type of emergency disconnect sequence to be completed.

8. The rig control interface of claim 1, wherein the emergency disconnect sequence timer display includes a plurality of progress bars corresponding to the plurality of functions being performed by the devices in the one or both of the lower marine riser package and the blowout preventer stack as a consequence of the initiation of the emergency disconnect sequence.

9. The rig control interface of claim 1, wherein the emergency disconnect sequence timer display includes a progress bar corresponding to the time elapsed after the initiation of the emergency disconnect sequence signal.

10. The rig control interface of claim 1, wherein the emergency disconnect sequence timer display includes a progress bar corresponding to time remaining for the completion of the emergency disconnect sequence.

11. The rig control interface of claim 1, wherein the emergency disconnect sequence timer display includes a progress bar comprising a completed portion corresponding to the time elapsed after the initiation of the emergency disconnect sequence and an uncompleted portion corresponding to time remaining for completion of the emergency disconnect sequence.

12. The rig control interface of claim 1, further comprising an emergency disconnect sequence completion indicator.

13. The rig control interface of claim 1, wherein the emergency disconnect sequence button is a physical button and wherein the interface includes an emergency disconnect sequence icon that is activated upon activation of the physical emergency disconnect sequence button.

14. A rig control system, the system comprising:

a processor;

a first plurality of sensors connected to a blowout preventer stack;

a second plurality of sensors connected to a lower marine riser package releasably connectable to the blowout preventer stack;

a multiplex pod connected to the lower marine riser package, the multiplex pod configured to receive an emergency disconnect sequence signal from the processor and to transport electric and/or hydraulic control signals to devices in one or both of the lower marine riser package and the blowout preventer stack in response to the emergency disconnect sequence signal; and a stack screen connected to the processor, the stack screen including:

an emergency disconnect sequence button configured to initiate the emergency disconnect sequence signal sent to the multiplex pod resulting in an emergency disconnect sequence including a plurality of functions being performed by the devices in the one or both of the lower marine riser package and the blowout preventer stack; and an emergency disconnect sequence timer display triggered by initiation of the emergency disconnect sequence signal, the emergency disconnect sequence timer display configured to indicate one or both of time elapsed after initiation of the emergency disconnect sequence signal and a status of the plurality of functions being performed by the devices in the one or both of the lower marine riser package and the blowout preventer stack.

15. The rig control system of claim 14, wherein the stack screen is a touch screen including the emergency disconnect sequence button and the emergency disconnect sequence timer display as touch-screen displays.

16. The rig control system of claim 15, wherein the emergency disconnect sequence button touch-screen display is located adjacent to the emergency disconnect sequence timer touch-screen display.

17. The rig control system of claim 15, wherein the emergency disconnect sequence timer touch-screen display is a pop-up display.

18. The rig control system of claim 17, wherein when the emergency disconnect sequence timer touch-screen pop-up display is in an active state, visual access of the remaining portion of the touch screen is inhibited.

19. The rig control system of claim 14, wherein the stack screen is a computer display including the emergency disconnect sequence button as selectable control and the emergency disconnect sequence timer as a display on the computer display.

20. The rig control system of claim 14, wherein the stack screen is a physical control panel including the emergency disconnect sequence button as a physical button.

21. The rig control system of claim 14, wherein the emergency disconnect sequence timer display includes a numerical display of the time elapsed after the initiation of the emergency disconnect sequence signal.

22. The rig control system of claim 14, wherein the emergency disconnect sequence timer display includes a plurality of progress bars corresponding to the plurality of functions being performed by the devices in the one or both of the lower marine riser package and the blowout preventer stack as a consequence of the initiation of the emergency disconnect sequence.

23. The rig control system of claim 14, wherein the emergency disconnect sequence timer display includes a progress bar corresponding to the time elapsed after the initiation of the emergency disconnect sequence signal.

24. The rig control system of claim 14, wherein the stack screen further includes an emergency disconnect sequence completion indicator.

25. A method for disconnecting a lower marine riser package from a blowout preventer stack, the method comprising:

receiving an emergency disconnect sequence initiation input, the emergency disconnect sequence initiation input to initiate an emergency disconnect sequence signal sent to multiplex pods resulting in an emergency disconnect sequence including a plurality of functions being performed by devices in one or both of the lower marine riser package and the blowout preventer stack;

identifying the emergency disconnect sequence being fired;

setting an emergency disconnect sequence timer to indicate one or both of time elapsed after initiation of the emergency disconnect sequence signal and a status of the plurality of functions being performed by the devices in the one or both of the lower marine riser package and the blowout preventer stack; and outputting the one or both of the time elapsed after initiation of the emergency disconnect sequence signal and the status of the plurality of functions being performed by the devices in the one or both of the lower marine riser package and the blowout preventer stack.

* * * * *